US008805218B2

(12) United States Patent
Takahashi et al.

(10) Patent No.: US 8,805,218 B2
(45) Date of Patent: Aug. 12, 2014

(54) IMAGE FORMING APPARATUS, TONER IMAGE TRANSFER AND FIXING METHOD, AND COMPUTER-READABLE RECORDING MEDIUM HAVING RECORDED THEREON TONER IMAGE TRANSFER AND FIXING PROGRAM

(75) Inventors: Masashi Takahashi, Kanagawa-ken (JP); Takeshi Watanabe, Kanagawa-ken (JP); Shoko Shimmura, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 711 days.

(21) Appl. No.: 13/020,361

(22) Filed: Feb. 3, 2011

(65) Prior Publication Data

US 2011/0200345 A1 Aug. 18, 2011

Related U.S. Application Data

(60) Provisional application No. 61/305,371, filed on Feb. 17, 2010.

(51) Int. Cl.
*G03G 15/00* (2006.01)
*G03G 15/16* (2006.01)

(52) U.S. Cl.
USPC ..... 399/45; 399/307

(58) Field of Classification Search
USPC ..... 399/45, 68, 202, 307, 308
See application file for complete search history.

(56) References Cited

U.S. PATENT DOCUMENTS 6,501,934 B1 * 12/2002 Ahuja et al. ..... 399/307
7,711,301 B2 * 5/2010 Takemoto et al. ..... 399/302 X

FOREIGN PATENT DOCUMENTS

JP 2006264928 A * 10/2006
JP 2007264593 10/2007

* cited by examiner

*Primary Examiner* — David Gray
*Assistant Examiner* — Erika J Villaluna
(74) *Attorney, Agent, or Firm* — Amin, Turocy & Watson, LLP

(57) ABSTRACT

According to one embodiment, an image forming apparatus includes a photoconductive member, an intermediate transfer belt, a transfer and fixing belt, a fixing and pressing roller, and a heating device. The heating device heats a toner image on the transfer and fixing belt between a first toner image transfer position for transfer from the intermediate transfer belt onto the transfer and fixing belt and a second toner image transfer position for transfer from the transfer and fixing belt onto a sheet in a moving direction of a belt surface of the transfer and fixing belt and, at the same time, heats the sheet conveyed to the second toner image transfer position.

10 Claims, 9 Drawing Sheets

IMAGE FORMING APPARATUS, TONER IMAGE TRANSFER AND FIXING METHOD, AND COMPUTER-READABLE RECORDING MEDIUM HAVING RECORDED THEREON TONER IMAGE TRANSFER AND FIXING PROGRAM

CROSS-REFERENCE TO RELATED APPLICATION

This application is also based upon and claims the benefit of priority from U.S. provisional application 61/305,371, filed on Feb. 17, 2010; the entire contents of which are incorporated herein by reference.

FIELD

Embodiments described herein relate generally to a toner image transfer technique in an image forming apparatus.

BACKGROUND

In the past, an image forming apparatus is known that transfers a toner image from a photoconductive member onto a sheet via an intermediate transfer belt and a transfer and fixing belt.

In the image forming apparatus, deterioration in image quality occurs because a transfer process from the intermediate transfer belt to the transfer and fixing belt is added compared with an image forming apparatus that transfers a toner image from a photoconductive member to a sheet via only an intermediate transfer belt.

DETAILED DESCRIPTION

Figure 1:
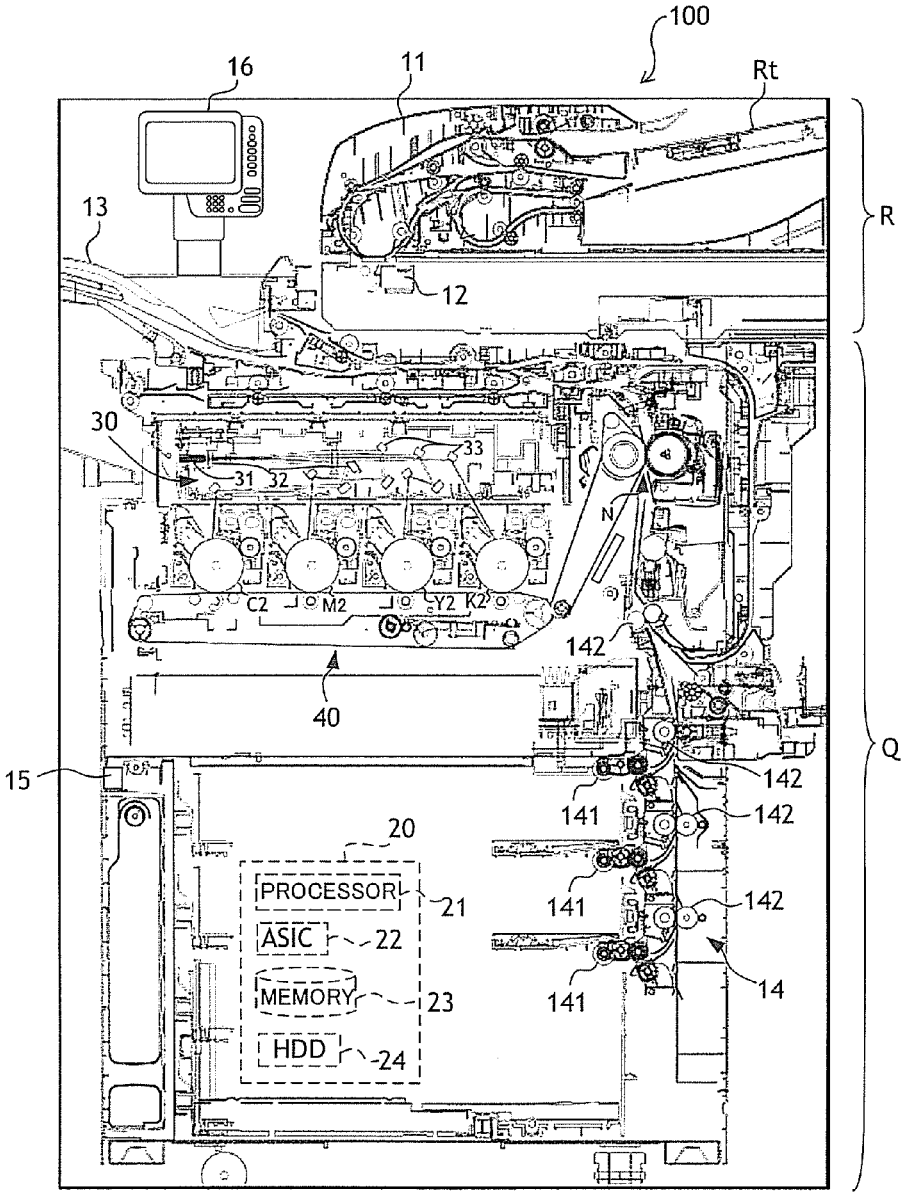
FIG. 1 is a sectional view of an image forming apparatus.

In general, according to one embodiment, an image forming apparatus includes: a photoconductive member configured to carry a toner image; an endless annular intermediate transfer belt onto which the toner image is transferred from the photoconductive member; an endless annular transfer and fixing belt onto which the toner image is transferred from the intermediate transfer belt; a fixing and pressing roller configured to nip and convey a sheet in cooperation with a belt surface of the transfer and fixing belt; and a heating device configured to heat the toner image on an outer circumferential surface of the transfer and fixing belt between a first toner image transfer position for transfer from the intermediate transfer belt onto the transfer and fixing belt and a second toner image transfer position for transfer from the transfer and fixing belt onto the sheet in a moving direction of the belt surface of the transfer and fixing belt and, at the same time, heat the sheet conveyed to the second toner image transfer position.

In general, according to another embodiment, a toner image transfer and fixing method is a toner image transfer and fixing method on a sheet by an image forming apparatus including: a photoconductive member configured to carry a toner image; an endless annular intermediate transfer belt onto which the toner image is transferred from the photoconductive member; an endless annular transfer and fixing belt onto which the toner image is transferred from the intermediate transfer belt; and a fixing and pressing roller configured to nip and convey a sheet in cooperation with a belt surface of the transfer and fixing belt, the method including: heating, with a heating device, the toner image on an outer circumferential surface of the transfer and fixing belt between a first toner image transfer position for transfer from the intermediate transfer belt onto the transfer and fixing belt and a second toner image transfer position for transfer from the transfer and fixing belt onto the sheet in a moving direction of the belt surface of the transfer and fixing belt and, at the same time, heating, with the heating device, the sheet conveyed to the second toner image transfer position; and nipping and pressing the heated sheet with the transfer and fixing belt, which carries the heated toner image, and the fixing and pressing roller to transfer the toner image on the transfer and fixing belt onto the sheet and fix the toner image.

In general, according to still another embodiment, a computer-readable recording medium having recorded thereon a toner image transfer and fixing program is a computer-readable recording medium having recorded thereon a toner image transfer and fixing program for causing a computer to execute transfer and fixing of a toner image on a sheet in an image forming apparatus including: a photoconductive member configured to carry a toner image; an endless annular intermediate transfer belt onto which the toner image is transferred from the photoconductive member; an endless annular transfer and fixing belt onto which the toner image is transferred from the intermediate transfer belt; and a fixing and pressing roller configured to nip and convey a sheet in cooperation with a belt surface of the transfer and fixing belt, the image forming apparatus including a heating device facing a belt surface between a first toner image transfer position for transfer from the intermediate transfer belt onto the transfer and fixing belt and a second toner image transfer position for transfer from the transfer and fixing belt onto the sheet in a moving direction of the belt surface of the transfer and fixing belt and facing the sheet conveyed to the second toner image transfer position, the program causing the computer to execute: a step of heating, with the heating device, the toner image on an outer circumferential surface of the transfer and fixing belt between the first toner image transfer position and the second toner image transfer position in the moving direction of the belt surface of the transfer and fixing belt and, at the same time, heating, with the heating device, the sheet conveyed to the second toner image transfer position; and a step of nipping and pressing the heated sheet with the transfer and fixing belt, which carries the heated toner image, and the fixing and pressing roller to transfer the toner image on the transfer and fixing belt onto the sheet and fix the toner image.

First Embodiment

A first embodiment is explained below with reference to the accompanying drawings.

FIG. 1 is a sectional view of an image forming apparatus 100.

The image forming apparatus 100 is a color image forming apparatus of a transfer and fixing system of a quadruple tandem type.

The image forming apparatus 100 includes an image reading unit R and an image forming unit Q.

The image reading unit R reads a sheet document and a book document.

The image reading unit R includes an auto document feeder (ADF) 11 and a scanning optical system 12. The auto document feeder 11 automatically conveys a sheet document on a document tray Rt to an image reading position of the scanning optical system 12. The scanning optical system 12 reads a sheet document conveyed to the image reading position and a book document placed on a document table.

The image forming unit Q forms a toner image on a sheet on the basis of printing data of the sheet document and the book document read by the scanning optical system 12 or printing data transmitted to the image forming apparatus 100 by an external apparatus.

The image forming unit Q includes a discharge tray 13, a conveying device 14, a communication unit 15, an operation display unit 16, a control unit 20, a laser optical system 30, and a transfer device 40.

The conveying device 14 includes pickup rollers 141 and conveying rollers 142. The pickup rollers 141 pick up sheets in cassettes. The conveying rollers 142 convey the picked-up sheets to a tertiary transfer position N for a toner image. Among the conveying rollers 142 denoted by the reference numeral, the conveying rollers 142 closest to the tertiary transfer position N are registration rollers configured to arrange the posture of a sheet when the leading end of the sheet is abutted against the registration rollers.

The laser optical system 30 scans photoconductive members 2Y to 2K of the transfer device 40 and forms electrostatic latent images on the photoconductive members 2Y to 2K. The laser optical system 30 includes laser semiconductors, a polygon mirror 31, a lens 32, and a mirror 33. The laser semiconductors are provided for respective colors C, M, Y, and K. Laser beams for the respective colors emitted from the laser semiconductors are reflected by the polygon mirror 31 and corrected passing through the lens 32. The corrected laser beams for the respective colors are reflected by the mirror 33 and form electrostatic latent images on photoconductive surface of the photoconductive members 2Y to 2K provided for the respective colors.

Figure 2:
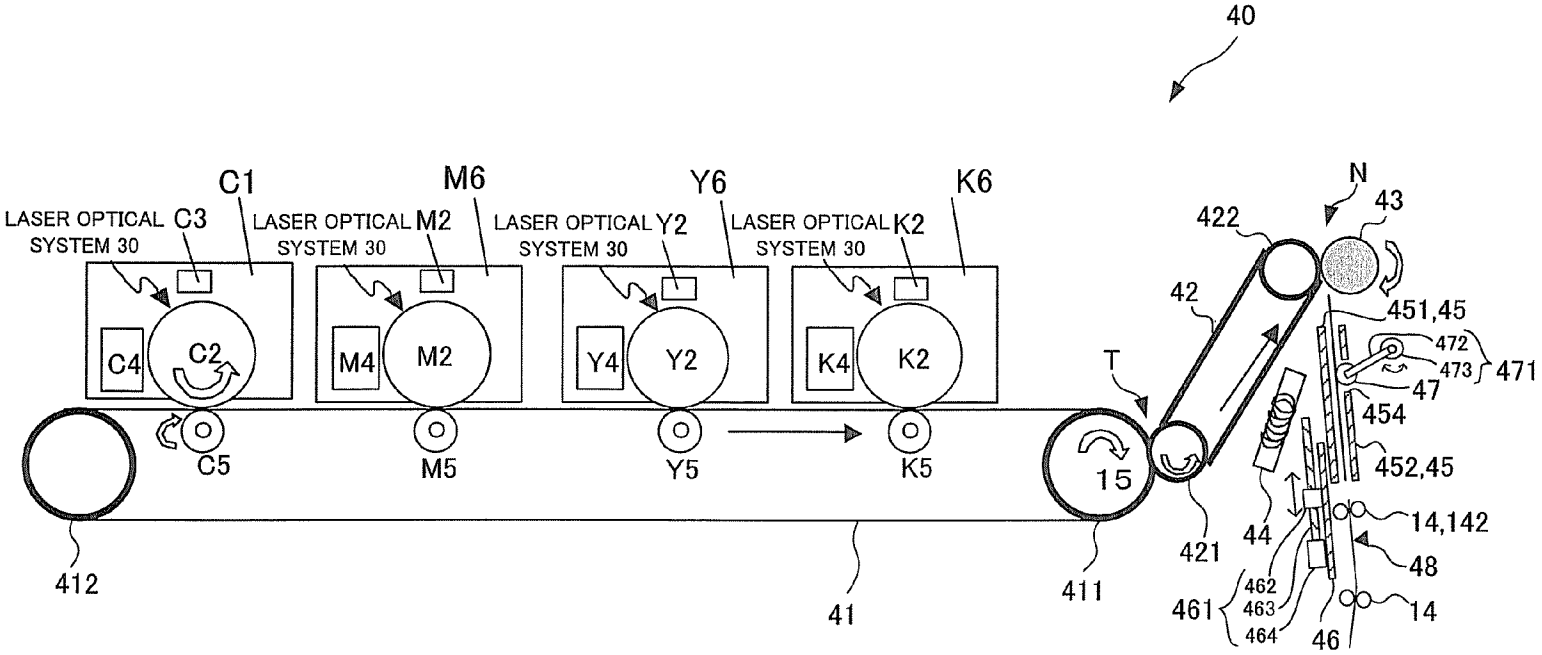
FIG. 2 is an enlarged view of a transfer device.

FIG. 2 is an enlarged view of the transfer device 40.

The transfer device 40 reversely develops the electrostatic latent images on the photoconductive members 2Y to 2K to form toner images and transfers the toner images onto a sheet.

The transfer device 40 includes drum units C1 to K1, an intermediate transfer belt 41, transfer rollers C5 to K5, a transfer and fixing belt 42, and a fixing and pressing roller 43.

First, the drum units C1 to K1 for the respective colors are explained using the drum unit C1 as an example.

The drum unit C1 includes a photoconductive drum C2 (a photoconductive member), an electrifying charger C3, and a developing device C4.

The photoconductive drum C2 is formed in a cylindrical shape having a diameter of 30 mm. The photoconductive drum C2 rotates in an arrow direction in FIG. 2.

The electrifying charger C3 uniformly charges the photoconductive drum C2 to, for example, −600 V in a scorotron system. The photoconductive drum C2 may be subjected to contact charging by a conductive roller, brush, blade, or the like instead of the electrifying charger C3.

A laser beam for cyan from the laser optical system 30 exposes a portion corresponding to a cyan image on the photoconductive surface of the photoconductive drum C2. In the exposed portion corresponding to the cyan image, minus charges are removed according to the intensity of the laser beam and minus potential is lower than that around the portion (e.g., −200 V to −300 V).

The developing device C4 stores a developer including a cyan toner to be negatively charged and a carrier to be positively charged. A development bias of, for example, −400 V is applied to the developing device C4. The photoconductive surface of the photoconductive drum C2 is uniformly charged to, for example, −600 V. However, in the portion exposed by the laser beam, minus potential is lower than development bias (e.g., −400 V) of the developing device C4 (e.g., −200 V to −300 V). The developing device C4 supplies the negative toner to the portion on the photoconductive drum C2 having the minus potential lower than the development bias and forms a cyan toner image.

The photoconductive drum C2 transfers the toner image carried thereon onto the intermediate transfer belt 41.

In the drum units M1 to K1, a magenta developer is stored in a developing device M4, a yellow developer is stored in a developing device Y4, and a black developer is stored in a developing device K4. Otherwise, the drum units M1 to K1 are the same as the drum unit C1.

The intermediate transfer belt 41 is formed in an endless annular shape. The intermediate transfer belt 41 is rotated in an arrow direction in FIG. 2 by a driving roller 411 and a driven roller 412. In the intermediate transfer belt 41, photoconductive drums C2, M2, Y2, and K2 are in contact with the intermediate transfer belt 41 in order from an upstream side in the belt rotating direction between a region in contact with the driving roller 411 and a region in contact with the driven roller 412. The width in a vertical direction on the paper surface of FIG. 2 in the intermediate transfer belt 41 is substantially equal to the length of the photoconductive drum C2 in the vertical direction on the paper surface of FIG. 2. A distance from the driving roller 411 to the driven roller 412 is about 300 mm. The driven roller 412 is driven to rotate according to the rotation of the driving roller 411. The driven roller 412 urges the intermediate transfer belt 41 to a side away from the driving roller 411 and applies, to the intermediate transfer belt 41, sufficient tension for preventing the intermediate transfer belt 41 from slipping.

Figure 3:
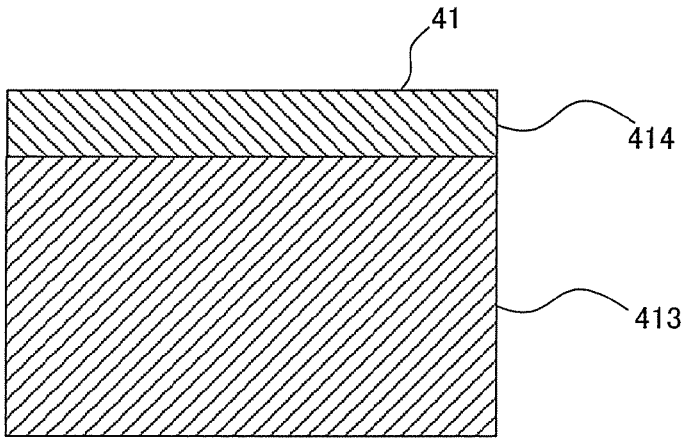
FIG. 3 is a sectional view of an intermediate transfer belt.

FIG. 3 is a sectional view of the intermediate transfer belt 41.

The intermediate transfer belt 41 is an elastic laminated belt including a rubber elastic layer 413 and a surface layer 414 and has a two-layer structure.

The rubber elastic layer 413 is made of urethane rubber and has volume resistance of 10 to the 10th power ohm cm and thickness of 200 μm.

The surface layer 414 is laminated on the rubber elastic layer 413. The surface layer 414 is made of PTFE (PolyTetraFluoroEthylene) and has thickness of 10 μm.

Figure 4:
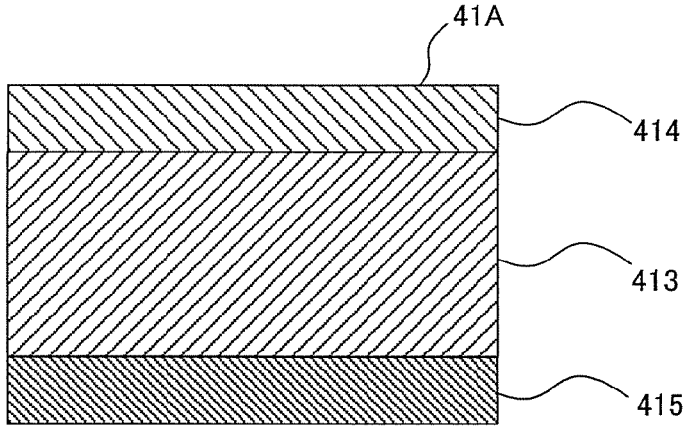
FIG. 4 is a sectional view of an intermediate transfer belt in a modification.

FIG. 4 is a sectional view of an intermediate transfer belt 41A in a modification.

The intermediate transfer belt 41A may have a three-layer structure including a base material layer 415, the rubber elastic layer 413, and the surface layer 414.

The base material layer 415 is made of polyimide in order to secure the strength of the intermediate transfer belt 41A. The base material layer 415 has volume resistance of 10 to the 8th power ohm cm and thickness of 80 μm. The base material layer 415 may be made of PVDF (PolyVinylidene DiFluoride) or polycarbonate resin. An ion conductive agent may be used for the base material layer 415 as an additive for imparting electric conductivity to the base material layer 415.

The rubber elastic layer 413 is laminated on the base material layer 415. The rubber elastic layer 413 is made of conductive urethane rubber in which carbon is dispersed. The rubber elastic layer 413 has volume resistance of 10 to 10th power ohm cm and thickness of 160 μm.

The surface layer 414 is laminated on the rubber elastic layer 413. The surface layer 414 is made of insulative fluorine resin taking into account toner releasability and durability of the intermediate transfer belt 41A. The surface layer 414 has thickness of 5 μm.

Referring back to FIG. 2, the transfer rollers C5 to K5 are opposed to the photoconductive drums C2 to K2 across the intermediate transfer belt 41. Each of the transfer rollers C5 to K5 includes a cored bar (a shaft) having a diameter of ϕ10 mm and a foamed urethane roller having an external diameter of ϕ18 mm provided around the cored bar. The cored bar is connected to a constant voltage DC power supply. The foamed urethane roller is made of conductive foamed urethane in which carbon is dispersed. Electric resistance between the cored bar and the surface of the foamed urethane roller is about 10e6Ω. Both ends of the cored bar (the shaft) are urged by springs, whereby each of the transfer rollers C5 to K5 is urged vertically to the intermediate transfer belt 41. Urging force of the springs applied to the cored bar is 600 gf.

A bias voltage of about +1000 V is applied to the transfer rollers C5 to K5. When the bias voltage is applied to the transfer roller 5C, a transfer electric field is formed between the transfer roller C5 and the photoconductive drum C2. The negatively-charged cyan toner image on the photoconductive drum C2 is primarily transferred onto the intermediate transfer belt 41 by the transfer electric field. When the intermediate transfer belt 41 moves and the cyan toner image comes right below a photoconductive drum M2, a bias voltage is applied to the transfer roller M5 and a magenta toner image on the photoconductive drum M2 is superimposed on the cyan toner image. Similarly, when the intermediate transfer belt 41 moves to a downstream side and the toner images come right below a photoconductive drum Y2, a yellow toner image is superimposed on the toner images on the intermediate transfer belt 41. When the intermediate transfer belt 41 further moves to the downstream side and the toner images come right below the photoconductive drum K2, a black toner image is superimposed on the toner images on the intermediate transfer belt 41 and a color image is formed on the intermediate transfer belt 41.

An electric field forming member configured to form a transfer electric field is not limited to the transfer rollers C5 to K5 and only has to be a member that has electric conductivity and comes into contact the intermediate transfer belt 41. The electric field forming member may be, for example, a conductive rubber blade, a conductive brush, and a conductive sheet. The conductive sheet may be a rubber material such as silicon rubber, urethane rubber, or EPDM (Ethylene Propylene Methylene Linkage) in which carbon is dispersed. The conductive sheet may be a resin material such as polycarbonate in which carbon is dispersed. The electric field forming member is desirably a member having volume resistance of 10e5 to 10e7 Ωcm.

The transfer and fixing belt 42 is formed in an annular endless shape and is rotated in the arrow direction in FIG. 2 by a transfer and driving roller 421 and a driven roller 422. The transfer and fixing belt 42 has a single-layer structure and includes a thermosetting polyimide resin layer having heat resistance. The transfer and fixing belt 42 only has to be a member having relatively high heat resistance and small heat capacity. The transfer and fixing belt 42 may be, for example, an aluminum metal thin layer belt manufactured by Ni (nickel) electro-casting, a stainless steel thin layer belt, or the like. A portion of the transfer and fixing belt 42 supported by the transfer and driving roller 421 adheres to the intermediate transfer belt 41. A position where the transfer and fixing belt 42 and the intermediate transfer belt 41 adhere is referred to as secondary transfer position T.

A bias voltage is applied to the transfer and driving roller 421. Consequently, when the toner images on the intermediate transfer belt 41 reaches the secondary transfer position T, the toner images are transferred onto the transfer and fixing belt 42 from the intermediate transfer belt 41.

The fixing and pressing roller 43 has elasticity. The fixing and pressing roller 43 adheres to a portion of the transfer and fixing belt 42 supported by the driven roller 422. A position where the fixing and pressing roller 43 and the transfer and fixing belt 42 adhere is referred to as a tertiary transfer position N (a nip portion). The fixing and pressing roller 43 nips and conveys a sheet in cooperation with a belt surface of the transfer and fixing belt 42. The fixing and pressing roller 43 nips and presses the sheet in cooperation with the belt surface of the transfer and fixing belt 42 to transfer the toner images on the transfer and fixing belt 42 onto the sheet and fix the toner images.

The transfer device 40 includes, besides the members explained above, a heating device 44, a guide member 45, a heat insulating plate 46, a heat-insulating-plate driving unit 461, an aluminum roller 47 (a cooling member), a cooling-member driving unit 471, and a thickness sensor 48.

The heating device 44 is a halogen lamp heater having width similar to that of the transfer and fixing belt 42 in the vertical direction on the paper surface of FIG. 2. The heating device 44 is located in a position facing the outer circumferential surface of the transfer and fixing belt 42 between the secondary transfer position T (a first toner image transfer position) for transfer of the toner images from the intermediate transfer belt 41 onto the transfer and fixing belt 42 and the tertiary transfer position N (a second toner image transfer position) for transfer of the toner images from the transfer and fixing belt 42 onto the sheet in the moving direction of the belt surface of the transfer and fixing belt 42. The heating device 44 is located in a position facing the transfer and fixing belt 42 side of a sheet conveying path to the tertiary transfer position N. The heating device 44 heats and melts the toner images on the outer circumferential surface of the transfer and fixing belt 42 and, at the same time, pre-heats the sheet conveyed to the tertiary transfer position N. The heating device 44 may be a silica tube heater or a ceramic heater.

The guide member 45 guides the sheet, which is conveyed from the conveying device 14, to the tertiary transfer position N. The guide member 45 includes a first guide member 451 configured to guide a transfer surface of the sheet onto which the toner images are transferred and a second guide member 452 configured to guide a rear surface of the sheet on the opposite side of the transfer surface. The width of the first and second guide members 451 and 452 in the vertical direction on the paper surface of FIG. 2 is larger than the width of a sheet having a largest size, which is a transfer target of the image forming apparatus 100.

Figure 5:
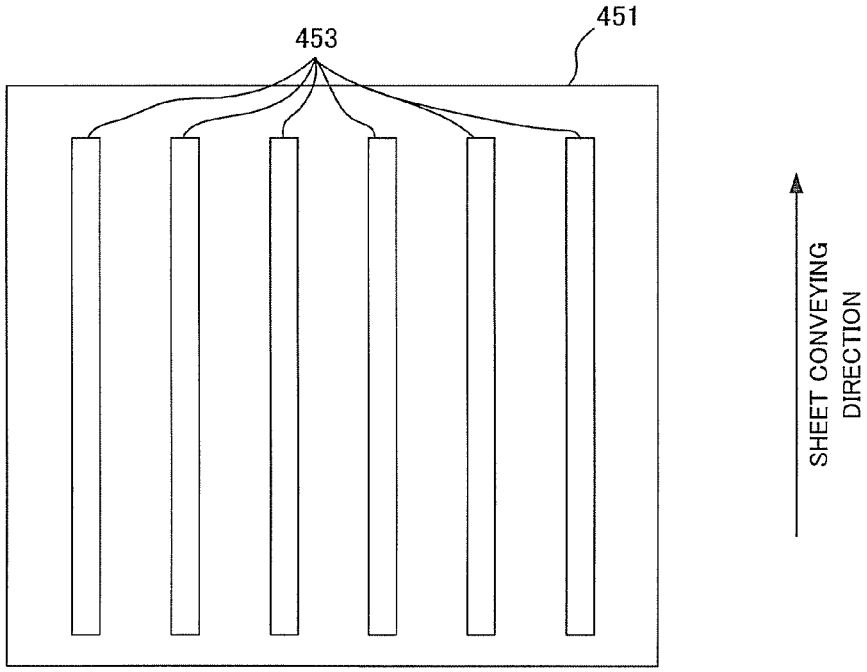
FIG. 5 is a plan view of a heat insulating plate.

The first guide member 451 includes plural slits 453 (long holes) extending in the sheet conveying direction (FIG. 5). Radiant heat of the heating device 44 is transmitted to the sheet, which is conveyed to the tertiary transfer position N, via the slits 453.

The second guide member 452 includes a slit 454 extending in the vertical direction on the paper surface of FIG. 2.

The heat insulating plate 46 has size enough for covering all the plural slits 453. The heat insulating plate 46 is made of a material that blocks the radiant heat from the heating device 44. The heating insulating plate 46 suppresses, with a portion located between the heating device 44 and the sheet conveyed to the tertiary transfer position N, heat transmission by radiation from the heating device 44 to the sheet. The heat insulating plate 46 also suppresses, with a portion located between the heating device 44 and the sheet conveyed to the tertiary transfer position N, conduction heat transmission and convection heat transmission from the heating device 44 to the sheet via the air.

The heat-insulating-plate driving unit 461 is a ball screw and includes a screw shaft 462, a nut 463 inserted over the screw shaft 462 and fixed to the heat insulating plate 46, and a motor 464 configured to rotate the screw shaft 462. The nut 463 includes plural balls. The plural balls circulate through a screw groove of the screw shaft 462 and the inside of the nut 463. The heat-insulating-plate driving unit 461 rotates the screw shaft 462 with the motor 464 and moves the nut 463 along the screw shaft 462 to thereby move the heat insulating plate 46 in the sheet conveying direction.

The aluminum roller 47 extends in the vertical direction on the paper surface of FIG. 2 and is excellent in heat conductivity. The aluminum roller 47 comes into contact with and separates from the rear surface of the sheet and adjusts the temperature of the sheet.

The cooling-member driving unit 471 includes an arm 472 configured to pivotably hold the aluminum roller 47 and a motor 473 fixed to a proximal end of the arm 472 and configured to pivot the arm 472. The cooling-member driving unit 471 pivots the arm 472 with the motor 473 to thereby bring the aluminum roller 47 into contact with and separate the aluminum roller 47 from the rear surface of the sheet.

The thickness sensor 48 detects the thickness of the sheet conveyed to the tertiary transfer position N. As the thickness sensor 48, for example, an optical sensor can be adopted. The thickness sensor 48 may be a sensor of any type. The conveying rollers 142 also serving as the registration rollers and denoted by the reference number in FIG. 2 may be used as a thickness sensor. When the conveying rollers 142 also serving as the registration rollers are used as the thickness sensor, for example, it is also possible to detect widening between the conveying rollers 142 at the time when the conveying rollers 142 nip the sheet and calculate the thickness of the sheet on the basis of a value of the detection. For example, it is also possible to detect force applied to the conveying rollers 142 when the conveying rollers 142 nip the sheet, which is force in a direction in which the conveying rollers 142 on both the sides separate from each other, and calculate thickness of the sheet on the basis of a value of the detection.

Figure 6:
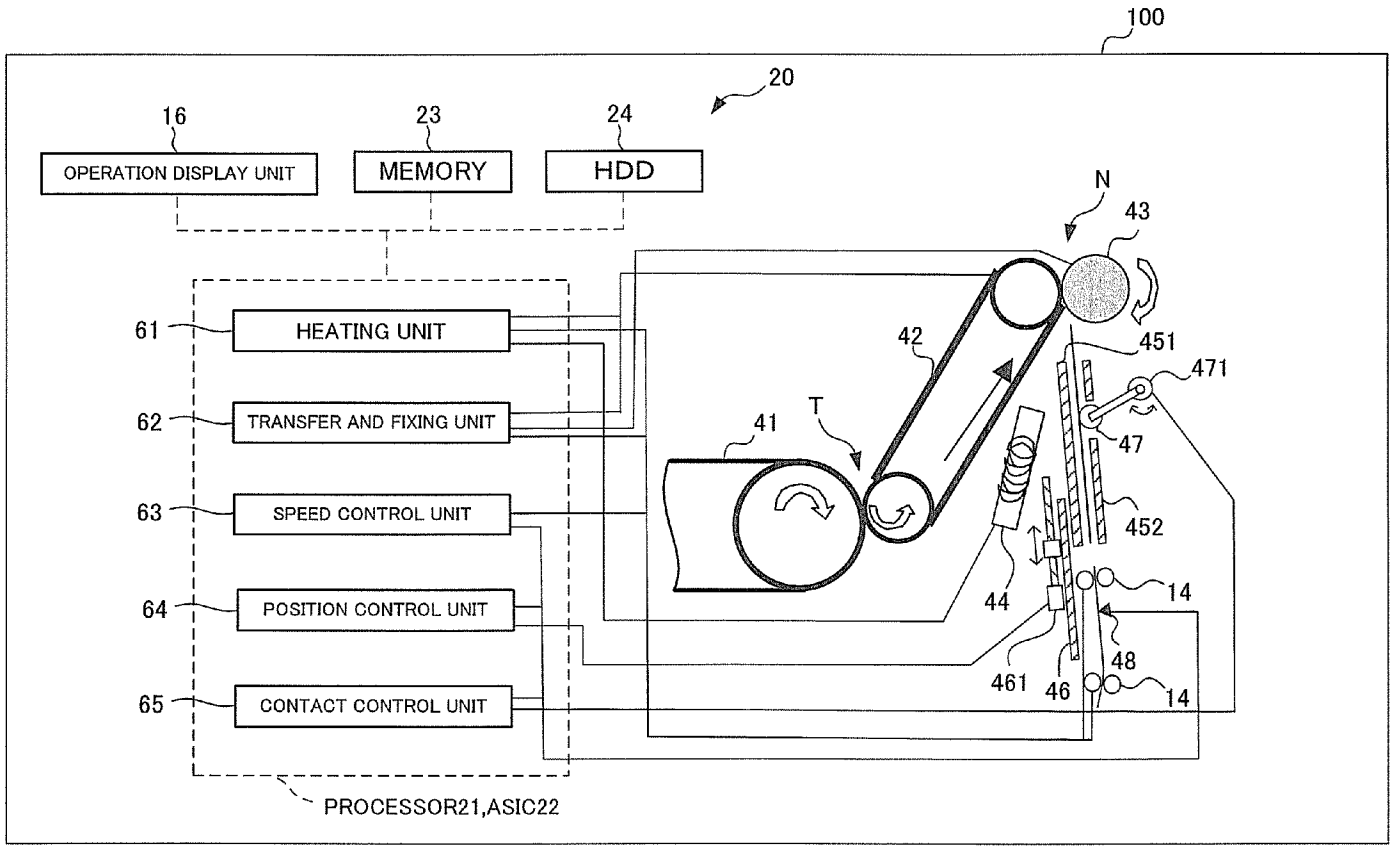
FIG. 6 is a diagram for explaining functions of a control unit.

FIG. 6 is a diagram for explaining functions of the control unit 20.

The control unit 20 controls the entire image forming apparatus 100. The control unit 20 includes a processor 21, an ASIC 22, a memory 23, and a HDD 24.

The processor 21 executes computer programs stored in the memory 23 to thereby realize various functions. The functions are realized as functional units 61 to 65. The functional units 61 to 65 may be realized by the ASIC 22. The processor 21 may be a CPU (Central Processing Unit) and an MPU (Micro Processing Unit). The memory 23 may be a RAM (Random Access Memory), a ROM (Read Only Memory), a DRAM (Dynamic Random Access Memory), an SRAM (Static Random Access Memory), and a VRAM (Video RAM). The HDD 24 may be a flash memory.

The operation display unit 16 outputs an input signal to the processor 21 and displays various kinds of information. A user can change various settings of the image forming apparatus 100 by operating the operation display unit 16.

Image formation processing by the control unit 20 is explained below.

When the operation display unit 16 is operated by the user and an instruction for start of image formation is input to the control unit 20, the control unit 20 controls the laser optical system 30, the photoconductive drums C2 to K2, the intermediate transfer belt 41, and the like and forms a color image on the intermediate transfer belt 41 on the basis of, for example, printing data read by the image reading unit R. Specifically, the control unit 20 rotates the photoconductive drums C2 to K2, causes electrifying chargers C3 to K3 to uniformly negatively charge the photoconductive drums C2 to K2, and causes the laser optical system 30 to form electrostatic latent images on the photoconductive drums C2 to K2. The electrostatic latent images on the photoconductive drums C2 to K2 are reversely developed into toner images of the respective colors by the developing devices C4 to K4. The control unit 20 applies, while rotating the intermediate transfer belt 41, bias voltages to the transfer rollers C5 to K5 to sequentially transfer the toner images of the respective colors on the photoconductive drums C2 to K2 onto the intermediate transfer belt 41 and form one color image. The control unit 20 rotates the intermediate transfer belt 41 and the transfer and fixing belt 42 and applies a bias voltage to the transfer and driving roller 421 to secondarily transfer the toner images from the intermediate transfer belt 41 onto the transfer and fixing belt 42 in the secondary transfer position T.

Figure 7:
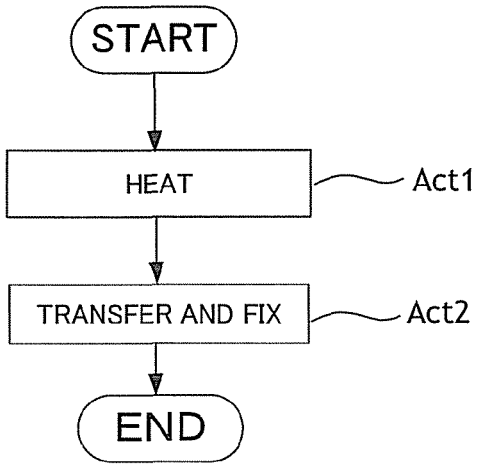
FIG. 7 is a flowchart for explaining processing for fixing a toner image on a sheet.

The control unit 20 causes the conveying device 14 to pick up a sheet in the cassettes and convey the sheet to the tertiary transfer position N. The control unit 20 transfers the toner images on the transfer and fixing belt 42 onto the sheet and fixes the toner images. Processing for transferring and fixing the toner images on the sheet by the control unit 20 is explained with reference to a flowchart of FIG. 7.

A heating unit 61 drives the heating device 44 while rotating the intermediate transfer belt 41 and the transfer and fixing belt 42. The heating unit 61 heats and melts, with the heating device 44, the toner images on the outer circumferential surface of the transfer and fixing belt 42 between the secondary transfer position T (the first toner image transfer position) for transfer of the toner images from the intermediate transfer belt 41 onto the transfer and fixing belt 42 and the tertiary transfer position N (the second toner image transfer position) for transfer of the toner images from the transfer and fixing belt 42 onto the sheet in the moving direction of the belt surface of the transfer and fixing belt 42.

At the same time, the heating unit 61 conveys the sheet to the tertiary transfer position N with the conveying device 14 via the first guide member 451 and the second guide member 452. In conveying the sheet, the heating unit 61 pre-heats the sheet with the heating device 44 via the slits 453 of the first guide member 451 (Act 1).

After Act 1, a transfer and fixing unit 62 nips and presses the pre-heated sheet with the transfer and fixing belt 42 and the fixing and pressing roller 43 to transfer the melted toner images on the transfer and fixing belt 42 onto the sheet (Act 2).

When the melted toner images are transferred onto the sheet, since a contact surface between the sheet and melted toners is hot and the melted toners have viscoelasticity, it is possible to satisfactorily entangle the melted toners with sheet fiber and efficiently transfer and fix the toner images on the sheet.

In an image forming apparatus in the past that transfers toner images from photoconductive members onto a sheet via an intermediate transfer belt and a transfer and fixing belt, unlike the image forming apparatus according to this embodiment in which the heating device 44 is provided on the outer side of the annular transfer and fixing belt, a heating device is provided on the inner side of the annular transfer and fixing belt. In such an image forming apparatus in the past, the transfer and fixing belt is heated from the inner side by the heating device to heat the toner images on the transfer and fixing belt. Therefore, it is difficult to perform temperature control for the transfer and fixing belt by the heating device. The toner images tend to adhere to the transfer and fixing belt.

However, in this embodiment, since the transfer and fixing belt 42 that carries the toner images is made of thermosetting polyimide, even if the transfer and fixing belt 42 is heated by the heating device 44, the temperature of the transfer and fixing belt 42 falls relatively quickly. Therefore, a contact surface side of the melted toners with the transfer and fixing belt 42 can be cooled and coagulated by the transfer and fixing belt 42. Therefore, in this embodiment, the toner images can be efficiently peeled off from the transfer and fixing belt 42.

If the transfer and fixing belt is made of thermosetting polyimide resin, it is likely that adhesion between the intermediate transfer belt and the transfer and fixing belt or between the fixing and pressing roller and the transfer and fixing belt decreases. However, in this embodiment, since the intermediate transfer belt 41 has elasticity, it is possible to cause the transfer and fixing belt 42 to sufficiently adhere to the intermediate transfer belt 41 in the secondary transfer position T. Therefore, in this embodiment, it is possible to perform secondary transfer without causing fixing unevenness in the secondary transfer position T. Further, in this embodiment, since the fixing and pressing roller 43 has elasticity, it is possible to cause the transfer and fixing belt 42 to sufficiently adhere to the fixing and pressing roller 43 in the tertiary transfer position N (the nip portion). Therefore, in this embodiment, it is possible to perform tertiary transfer without causing fixing unevenness in the tertiary transfer position N.

Since the transfer and fixing belt 42 is made of thermosetting polyimide resin, even if the transfer and fixing belt 42 is heated by the heating device 44, the temperature of the transfer and fixing belt 42 falls relatively quickly. Consequently, since the temperature of the transfer and fixing belt 42 sufficiently falls after the transfer of the toner images onto the sheet, the transfer and fixing belt 42 does not need to be cooled by a device.

In Act 2, the transfer and fixing unit 62 sets a difference of about 1% to 2% between the surface speed of the transfer and fixing belt 42 and the surface speed of the fixing and heating roller 43. Consequently, shearing force is generated in the sheet and efficiency of transfer and fixing is improved. Whichever of the surface speed of the transfer and fixing belt 42 and the surface speed of the fixing and pressing roller 43 may be set higher. The speed difference is satisfactory at about 2%. If the speed difference exceeds 3%, it is likely that irregularity occurs in a transferred image.

In the processing for transferring and fixing the toner images on the sheet, temperature control for the sheet is also important. If the temperature of the sheet is too high, the sheet itself tends to curl or the melted toners tend to remain on the transfer and fixing belt 42 side without being transferred onto the sheet side.

Figure 8:
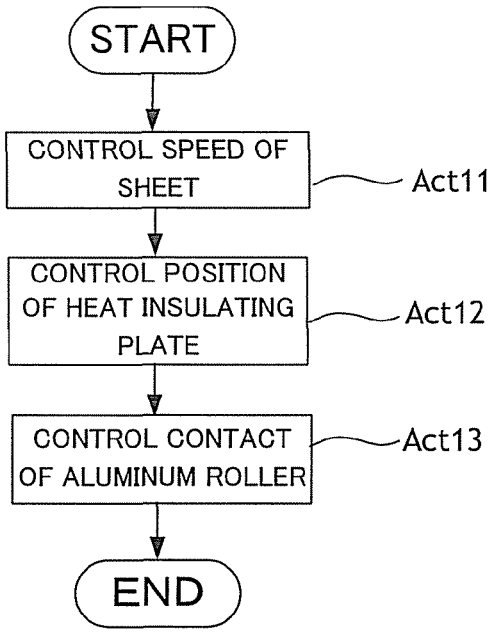
FIG. 8 is a flowchart for explaining temperature control for a sheet.

Therefore, in Act 1, the control unit 20 simultaneously performs the temperature control for the sheet. The temperature control for the sheet by the control unit 20 is explained below with reference to a flowchart of FIG. 8.

A speed control unit 63 controls the conveying device 14 on the basis of a detection result of the thickness sensor 48 and adjusts conveying speed of the sheet to thereby adjust a heat transmission amount from the heating device 44 to the sheet (Act 11). If the thickness sensor 48 detects that the sheet is thin, the speed control unit 63 increases the conveying speed of the sheet and reduces the heat transmission amount from the heating device 44 to the sheet (including a heat transmission amount by heat conduction and a heat transmission amount by convection other than a heat transmission amount by radiation). If the thickness sensor 48 detects that the sheet is thick, the speed control unit 63 reduces the conveying speed of the sheet and increases the heat transmission amount from the heating device 44 to the sheet.

Figure 9:
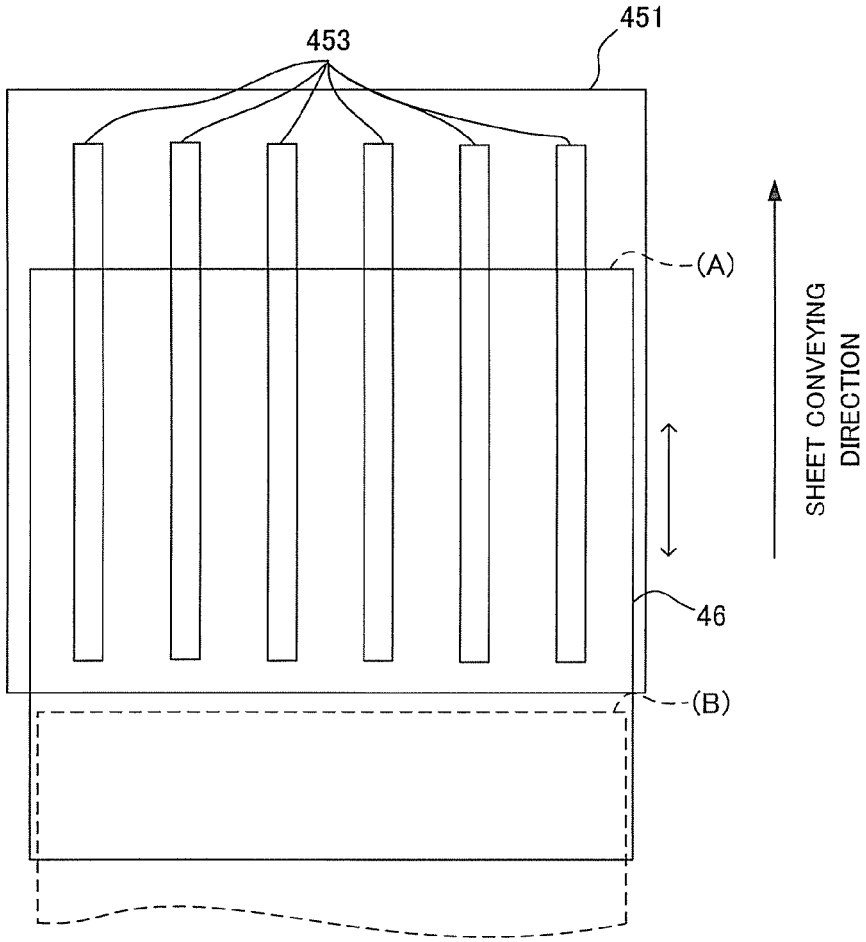
FIG. 9 is a plan view for explaining position control for the heat insulating plate.

After Act 11, a position control unit 64 controls the heat-insulating-plate driving unit 461 on the basis of a detection result of the thickness sensor 48 and adjusts the position of the heat insulating plate 46 to thereby adjust the heat transmission amount from the heating device 44 to the sheet (Act 12). If the thickness sensor 48 detects that the sheet is thin, the position control unit 64 moves the heat insulating plate 46 to, for example, a position (A) shown in FIG. 9 where the coverage of the slits 453 of the first guide member 451 is large and reduces the heat transmission amount from the heating device 44 to the sheet. If the thickness sensor 48 detects that the sheet is thick, the position control unit 64 moves the heat insulating plate 46 to, for example, a position (B) shown in FIG. 9 where the coverage of the slits 453 is small and increases the heat transmission amount from the heating device 44 to the sheet.

After Act 12, a contact control unit 65 controls the cooling-member driving unit 471 on the basis of a detection result of the thickness sensor 48 and brings the aluminum roller 47 into contact with and separates the aluminum roller 47 from the rear surface of the sheet to thereby adjust the temperature of the sheet (Act 13). If the thickness sensor 48 detects that the sheet is thin, the contact control unit 65 brings the aluminum roller 47 into contact with the rear surface of the sheet and drops the temperature of the sheet. If the thickness sensor 48 detects that the sheet is thick, the contact control unit 65 separates the aluminum roller 47 from the rear surface of the sheet and does not drop the temperature of the sheet.

After transferring and fixing the toner images on the sheet, the control unit 20 causes the conveying device 14 to convey the sheet downstream in the conveying path and discharge the sheet onto the discharge tray 13.

Second Embodiment

Functional units same as those in the first embodiment are denoted by the same reference numerals and signs and explanation of the functional units is omitted below.

Figure 10:
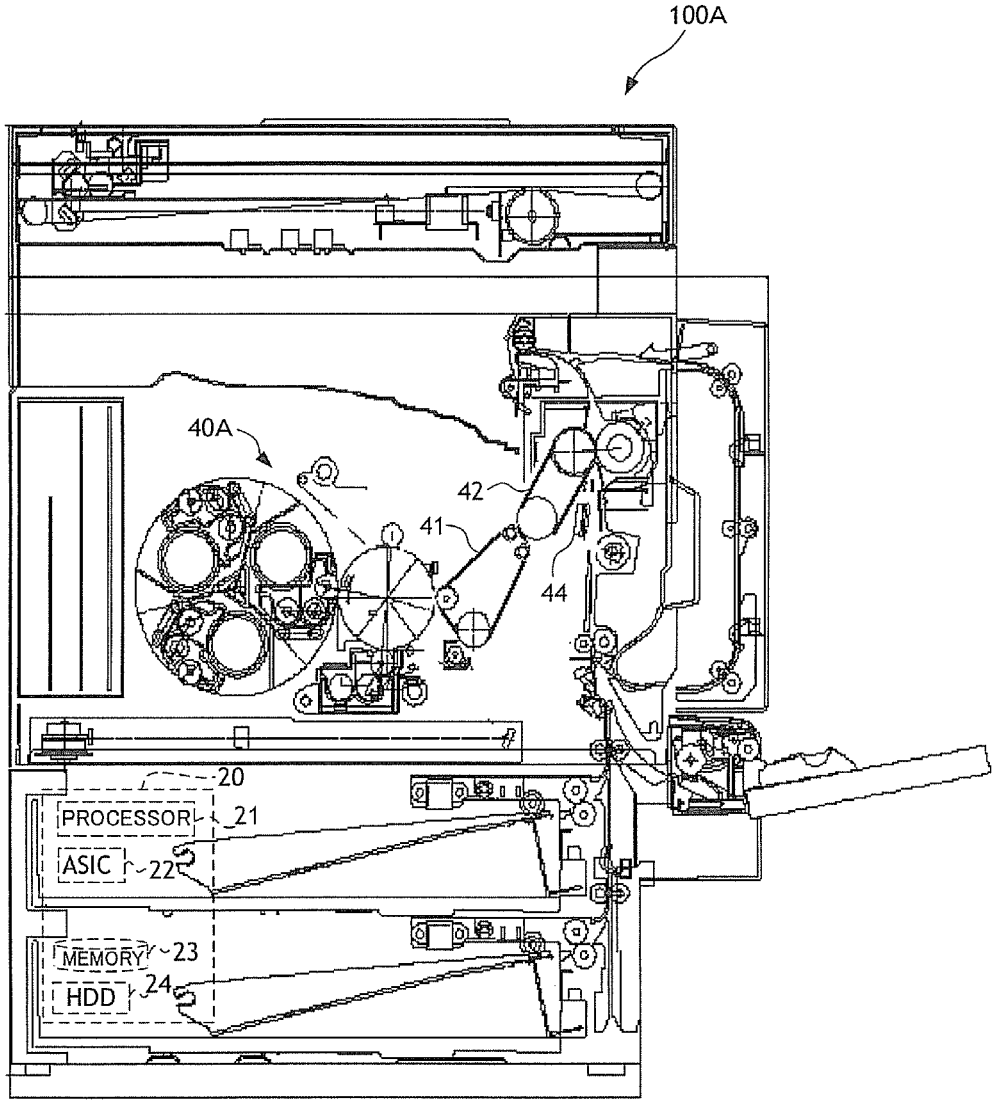
FIG. 10 is a sectional view of an image forming apparatus.
Figure 11:
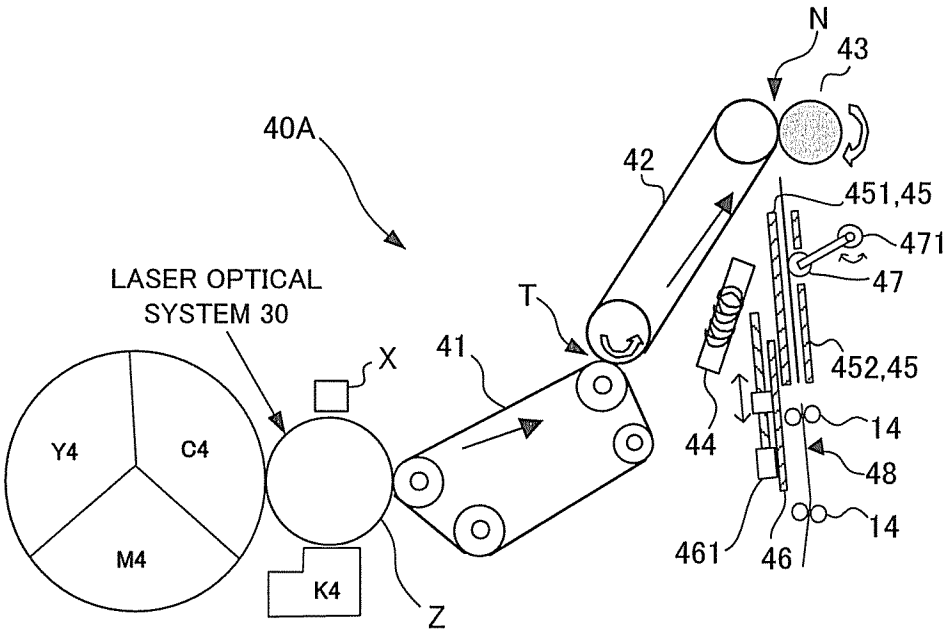
FIG. 11 is an enlarged view of a transfer device.

FIG. 10 is a sectional view of an image forming apparatus 100A. FIG. 11 is an enlarged view of a transfer device 40A.

The image forming apparatus 100A includes the transfer device 40A of a four cycle type. As shown in FIG. 11, after uniformly negatively charging a photoconductive drum Z with an electrifying charger X, the transfer device 40A forms, with the laser optical system 30, electrostatic latent images corresponding to images of predetermined colors on the photoconductive drum Z. The transfer device 40A supplies, with the developing devices C4 to K4 for the predetermined colors, toners of the predetermined colors onto the photoconductive drum Z. Consequently, the electrostatic latent images are reversely developed and toner images of the predetermined colors are formed on the photoconductive drum Z. The transfer device 40A repeats the cycle for the four colors C to K to form one color image on the photoconductive drum Z.

The image forming apparatus 100A includes the control unit 20 (FIG. 10), the heating device 44, the guide member 45, the heat insulating plate 46, the heat-insulating-plate driving unit 461, the aluminum roller 47, the cooling-member driving unit 471, and the thickness sensor 48 same as those in the first embodiment. Processing for transferring and fixing the toner images on the photoconductive drum Z onto a sheet is performed by the control unit 20 in the same manner as Acts 1 and 2 in the first embodiment. When the transfer and fixing processing is performed, temperature control processing for the sheet is performed by the control unit 20 in the same manner as Acts 11 to 13 in the first embodiment.

Modification

The shape of the heat insulating plate is not limited to a rectangular shape in plan view and may be an appropriate shape. The heat insulating plate may be a mesh-like heat insulating plate or a heat insulating plate having plural holes. A heat transmission amount from the heating device 44 to the sheet may be adjusted by a heat insulating plate including an appropriate number of holes having appropriate size.

A material of the cooling member is not limited to aluminum and may be appropriate metal, alloy, resin, or ceramics.

A form of the recording medium may be any form as long as the recording medium can store computer programs and can be read by a computer. Specifically, examples of the recording medium include an internal storage device internally mounted in a computer such as a ROM or a RAM, a portable recording medium such as a CD-ROM, a flexible disk, a DVD disk, a magneto-optical disk, or an IC card, a data base that stores a computer program, and other computers and databases of the computers. Functions obtained by installation or download may be functions for causing an OS (operating system) or the like in an apparatus to realize the functions in cooperation with the OS. A part or all of computer programs may be dynamically-generated execution modules.

The order of the respective kinds of processing in the embodiments is not limited to the order illustrated in the embodiments and may be different from the order illustrated in the embodiments.

As explained above in detail, according to the technique described in this specification, it is possible to provide a toner image transfer technique in an image forming apparatus.

While certain embodiments have been described, these embodiments have been presented by way of example only, and are not intended to limit the scope of invention. Indeed, the novel apparatus, methods and computer-readable medium described herein may be embodied in a variety of other forms; furthermore, various omissions, substitutions and changes in the form of the apparatus, methods and computer-readable medium described herein may be made without departing from the spirit of the inventions. The accompanying claims and their equivalents are intended to cover such forms or modifications as would fall within the scope and spirit of the inventions.

What is claimed is:

1. An image forming apparatus comprising:

a photoconductive member configured to carry a toner image;

an endless annular intermediate transfer belt onto which the toner image is transferred from the photoconductive member;

an endless annular transfer and fixing belt onto which the toner image is transferred from the intermediate transfer belt;

a fixing and pressing roller configured to nip and convey a sheet in cooperation with a belt surface of the transfer and fixing belt;

a heating device configured to heat the toner image on an outer circumferential surface of the transfer and fixing belt between a first toner image transfer position for transfer from the intermediate transfer belt onto the transfer and fixing belt and a second toner image transfer position for transfer from the transfer and fixing belt onto the sheet in a moving direction of the belt surface of the transfer and fixing belt and, at the same time, heat the sheet conveyed to the second toner image transfer position;

a heat insulating plate located between the heating device and the sheet conveyed to the second toner image transfer position and configured to suppress heat transmission from the heating device to the sheet;

a sensor configured to detect thickness of the sheet conveyed to the second toner image transfer position;

a heat-insulating-plate driving unit configured to move the heat insulating plate; and a control unit configured to control the heat-insulating-plate driving unit on the basis of a detection result of the sensor and adjust a position of the heat insulating plate to thereby adjust a heat transmission amount from the heating device to the sheet.

2. The apparatus according to claim 1, further comprising:

a conveying device configured to convey the sheet to the second toner image transfer position;

wherein the control unit is further configured to control the conveying device on the basis of the detection result of the sensor and adjust a conveying speed of the sheet to thereby adjust the heat transmission amount from the heating device to the sheet.

3. The apparatus according to claim 1, further comprising a cooling member configured to come into contact with and separate from a rear surface of the sheet to which the toner image is not transferred and adjust a temperature of the sheet.

4. The apparatus according to claim 3, further comprising:

a cooling-member driving unit configured to bring the cooling member into contact with and separate the cooling member from the rear surface of the sheet;

wherein the control unit is further configured to control the cooling-member driving unit on the basis of the detection result of the sensor and bring the cooling member into contact with and separate the cooling member from the rear surface of the sheet to thereby adjust the temperature of the sheet.

5. The apparatus according to claim 1, wherein a material of the transfer and fixing belt includes thermosetting polyimide, and the intermediate transfer belt is an elastic laminated belt made of at least two or more kinds of materials.

6. A toner image transfer and fixing method on a sheet by an image forming apparatus including: a photoconductive member configured to carry a toner image; an endless annular intermediate transfer belt onto which the toner image is transferred from the photoconductive member; an endless annular transfer and fixing belt onto which the toner image is transferred from the intermediate transfer belt; and a fixing and pressing roller configured to nip and convey the sheet in cooperation with a belt surface of the transfer and fixing belt, the method comprising:

heating, with a heating device, the toner image on an outer circumferential surface of the transfer and fixing belt between a first toner image transfer position for transfer from the intermediate transfer belt onto the transfer and fixing belt and a second toner image transfer position for transfer from the transfer and fixing belt onto the sheet in a moving direction of the belt surface of the transfer and fixing belt and, at the same time, heating, with the heating device, the sheet conveyed to the second toner image transfer position;

nipping and pressing the heated sheet with the transfer and fixing belt, which carries the heated toner image, and the fixing and pressing roller to transfer the toner image on the transfer and fixing belt onto the sheet and fix the toner image;

adjusting, with a heat insulating plate located between the heating device and the sheet conveyed to the second toner image transfer position, a heat transmission amount from the heating device to the sheet;

detecting a thickness of the sheet conveyed to the second toner image transfer position; and adjusting a position of the heat insulating plate on the basis of a detection result of the thickness of the sheet to thereby adjust the heat transmission amount from the heating device to the sheet.

7. The method according to claim 6, further comprising:

adjusting a conveying speed of the sheet to the second toner image transfer position on the basis of the detection result of the thickness of the sheet to thereby adjust the heat transmission amount from the heating device to the sheet.

8. The method according to claim 6, further comprising bringing a cooling member into contact with and separating the cooling member from a rear surface of the sheet to which the toner image is not transferred to thereby adjust temperature of the sheet.

9. The method according to claim 8, further comprising:

bringing the cooling member into contact with and separating the cooling member from the rear surface of the sheet on the basis of the detection result of the thickness of the sheet to adjust the temperature of the sheet.

10. The method according to claim 6, wherein a material of the transfer and fixing belt includes thermosetting polyimide, and the intermediate transfer belt is an elastic laminated belt made of at least two or more kinds of materials.

* * * * *